US007479007B2

(12) United States Patent
Kay

(10) Patent No.: US 7,479,007 B2
(45) Date of Patent: Jan. 20, 2009

(54) ULTRALIGHT COOKING STOVE

(76) Inventor: Robert L Kay, 17427 SE. 288th St., Kent, WA (US) 98042

( * ) Notice: Subject to any disclaimer, the term of this patent is extended or adjusted under 35 U.S.C. 154(b) by 511 days.

(21) Appl. No.: 11/163,418

(22) Filed: Oct. 18, 2005

(65) Prior Publication Data

US 2007/0084456 A1 Apr. 19, 2007

(51) Int. Cl.
*F24C 5/20* (2006.01)
*F24C 5/04* (2006.01)

(52) U.S. Cl. ..... 431/206; 431/203; 431/247; 126/43; 126/44; 126/39 R; 126/9 R

(58) Field of Classification Search ..... 431/206, 431/203, 247; 126/44, 9 R, 25 R
See application file for complete search history.

(56) References Cited

U.S. PATENT DOCUMENTS 1,421,209 A * 6/1922 Gehrer ..... 431/249
3,371,659 A * 3/1968 Paspalas ..... 126/43
4,164,930 A 8/1979 Johnston
4,793,321 A * 12/1988 Rafford et al. ..... 126/43
6,065,465 A * 5/2000 Fukada ..... 126/38

* cited by examiner

*Primary Examiner*—Steven B McAllister
*Assistant Examiner*—Nikhil Mashruwala
(74) *Attorney, Agent, or Firm*—David L. Tingey

(57) ABSTRACT

An ultralight stove comprises a fuel reservoir having a plurality of jet holes in the top through which vaporized fuel escapes and burns, a portion of which is directed toward a heat conducting heat transfer plug, heat from which being conducted through the heat transfer plug to the reservoir where it heats fuel in the reservoir causing increased fuel vaporization that pressurizes the reservoir which in turn causing pressurized fuel to escape through the jet holes resulting in increased heat to the heat transfer plug, the cycle continuing until a fuel consumption and temperature equilibrium is obtained where the heat transfer plug and reservoir reach maximum operating temperatures. An external fuel absorber on the reservoir top receives fuel which when ignited initially heats the heat transfer plug to initiate stove operation.

18 Claims, 3 Drawing Sheets

ULTRALIGHT COOKING STOVE

BACKGROUND

1. Field of the Invention

This invention relates to backpack stoves and more specifically to ultra light stoves that are self-pressurizing during operation.

2. Prior Art

It is known to have backpacking stoves, small and compact. These stoves are functional for the purpose for which they were designed, however, there remains a need for a simple but ultra light stove for the backpacking enthusiast seeking to minimize his or her backpack weight but requiring a stove that will generate intense heat.

The most popular ultralight stoves are alcohol stoves. The fuel is readily available and they are simple to build from aluminum cans and other readily available parts. Alcohol stoves can be grouped into three types: Open Flame; Open Jet; and Closed Jet stoves. As connoted by its name, the open flame stove comprises exposed alcohol ignited for heat. Open Jet stoves can be made from a cut-down beverage can with a top half inserted into a bottom half with overlapping side walls and are extremely light at a mere 0.3 ounces. Fuel is poured into the can through an open filler hole and ignited to heat the fuel, which causes the alcohol in the can to vaporize and shoot out small holes in the rim of the stove as flame jets that resemble a gas range. The closed jet stove is similar to the open jet stove except its filler hole is closed before ignition, or the filler hole may not exist if the stove is filled through several small holes in its top. The stove is initialized by a small amount of alcohol poured into a base around the can that causes the alcohol in the can to vaporize and build pressure. As with open jet stoves, closed jet stoves have a series of jets on the outer rim through which vaporized alcohol escapes and is vaporized into flames, which may also double as the filler holes. Heat generated from the flame jets heats the can, which in turn heats the alcohol within to sustain stove operation.

Advantages of these ultralight stoves are clear. They are very simple and require no maintenance and their simplicity allows them to be very light, in the range of an ounce or less. They are also very quiet.

However, the heat they generate is limited by the rate of self-generated heat conducted back to the liquid fuel contained within the stove. Because the conduction is limited to conduction through the container and radiation back to the stove from a pan on the stove, the rate of fuel consumption is not high and so the heat generated is consequently not high.

It is an object of the present invention to present a stove with pressure within the fuel reservoir self-generated by heat conducted through heat conduits heated directly by flames of burning fuel from the reservoir. It is a further object that fuel not burn within the reservoir but only upon exiting jet holes in the reservoir to better use and focus heat. It is a further object that the stove ignite without the use of an outside heater, such as fuel burning in a base about the reservoir.

SUMMARY

These objects are achieved in an ultralight stove comprising an unpressurized reservoir but self-pressurizing during stove operation by heat generated by burning of fuel in the reservoir which heat conducted back to the reservoir through a heat conduit central in the stove to heat fuel within the reservoir. With only a limited number of very small jet holes in the reservoir top through which vaporized fuel can escape, the reservoir becomes pressurized. Pressurized fuel vapor jets through the jet holes at a higher rate than from an unpressurized reservoir resulting in more heat generated for a faster heating of product on the stove.

Stove operation is initiated by igniting fuel added to an external recess in the reservoir top. The ignited fuel generates heat that is transferred to a heat-conducting heat transfer plug, which typically also serves to close a fuel filler hole central in the recess, extending upward from the top to intersect flame from burning fuel and also downward from the top into the reservoir to heat fuel in the reservoir. Heated reservoir fuel quickly pressurizes and vaporized fuel begins to jet from the jet holes where it is ignited by the burning fuel in the recess. Before that fuel in the recess is consumed, the stove becomes self-sustaining as vaporized fuel continues to exit the jet holes and burn.

Heat conduction is augmented by a heat transfer conduit extending from the heat transfer plug at the reservoir top to the reservoir bottom. An internal absorber is in the reservoir bottom heated by contact with the heat transfer conduit. The internal absorber is intended to capture remaining liquid fuel in the reservoir as fuel decreases in the reservoir so all fuel is heated and vaporized before the stove expires.

The stove is amenable to homemade construction from a beverage can. Typically a beverage can is cut transversely into two pieces with a large portion of its center removed. The beverage can bottom with a recess therein is adapted as the stove top. The can ends are joined with sides overlapping and are sealed together with a much-reduced height of about 1¼ inches. Sides of the can portion that becomes the stove top typically overlap longer sides of the can portion becoming the stove bottom so exposed can edges direct downward and end alongside sides of the stove bottom so can sides do not extend beyond the stove top where they might otherwise bend or cut.

Before the can sides are joined together, the internal structure of the stove is completed. Jet holes are punched in the stove top typically by a needle, typically on a ridge about the recess with a portion of the holes directed inward toward the recess center. This portion of the holes is punched in the inward side of the ridge about the recess so axes of these holes intersect the heat transfer plug when it is threaded into a rivet nut at the recess center, which also serves as the reservoir filler hole. Thus, as vaporized fuel exits these holes and is burned, resulting flames directed toward the heat transfer plug heats it.

The rivet nut is attached to a drilled hole in the stove top and the heat transfer conduit is attached to the rivet nut. An external fuel absorber is installed within the recess by closed pop rivets. Typically, a stainless steel fine mesh is secured by the pop rivets over the external fuel absorber to protect it and hold it in place so the absorber does not tear through the pop rivets. The internal fuel absorber is installed in the reservoir bottom and in contact with the heat transfer conduit extending to the reservoir bottom when assembled. As the can sides are then joined together with overlapping sides, the heat transfer conduit is adapted to bend slightly as it contacts internal fuel absorber at the reservoir bottom assuring the internal fuel absorber rests on the reservoir bottom.

In summary, to initiate stove operation fuel is added to the external fuel absorber and ignited to heat the heat transfer plug in the rivet nut. Heat from the heat transfer plug is transferred through the heat transfer conduit to heat and vaporize fuel within the reservoir therein pressurizing the reservoir. Pressurized fuel vapor is jetted through the jet holes, increasing the rate of fuel jetted through the jet holes and burned over an unpressurized reservoir. Vaporized fuel is initially ignited by burning fuel in the recess before fuel in the external fuel absorber is spent. Stove operation is then sustained through the pressurized fuel from that portion of the jet holes heating the heat transfer plug, which in turn warms the reservoir fuel through the heat transfer conduit to pressurize the reservoir with vaporized fuel which jets through the jet holes.

DETAILED DESCRIPTION OF THE PREFERRED EMBODIMENTS

Figure 1:
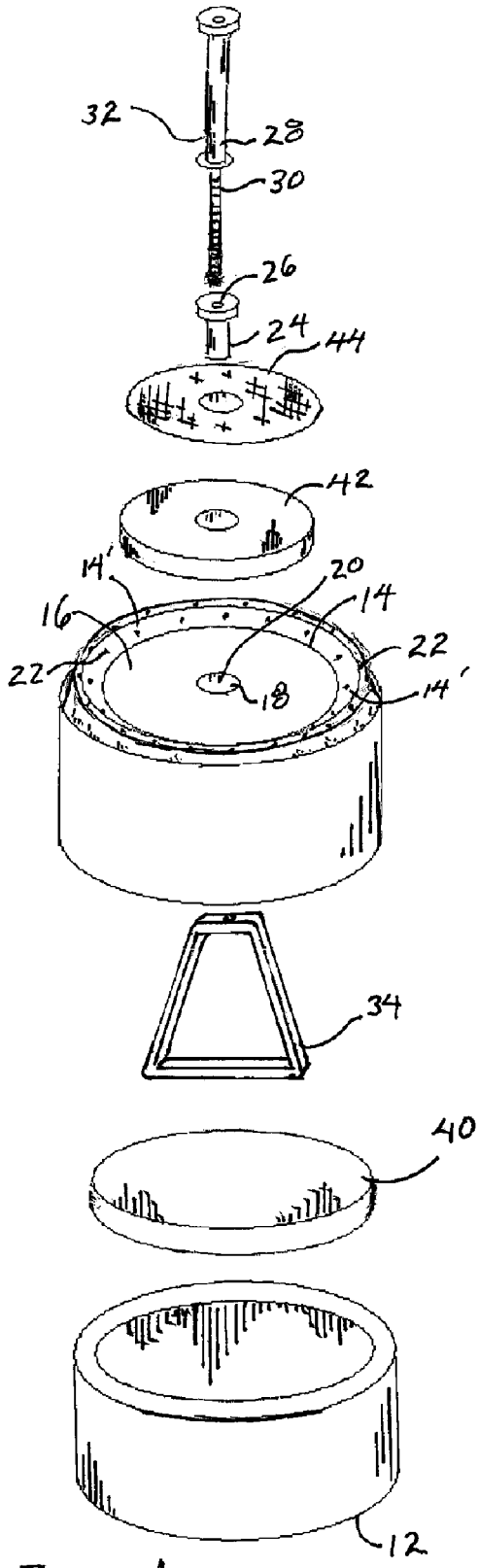
FIG. 1 is an exploded perspective view of the ultralight stove of the present invention before assembly.
Figure 2:
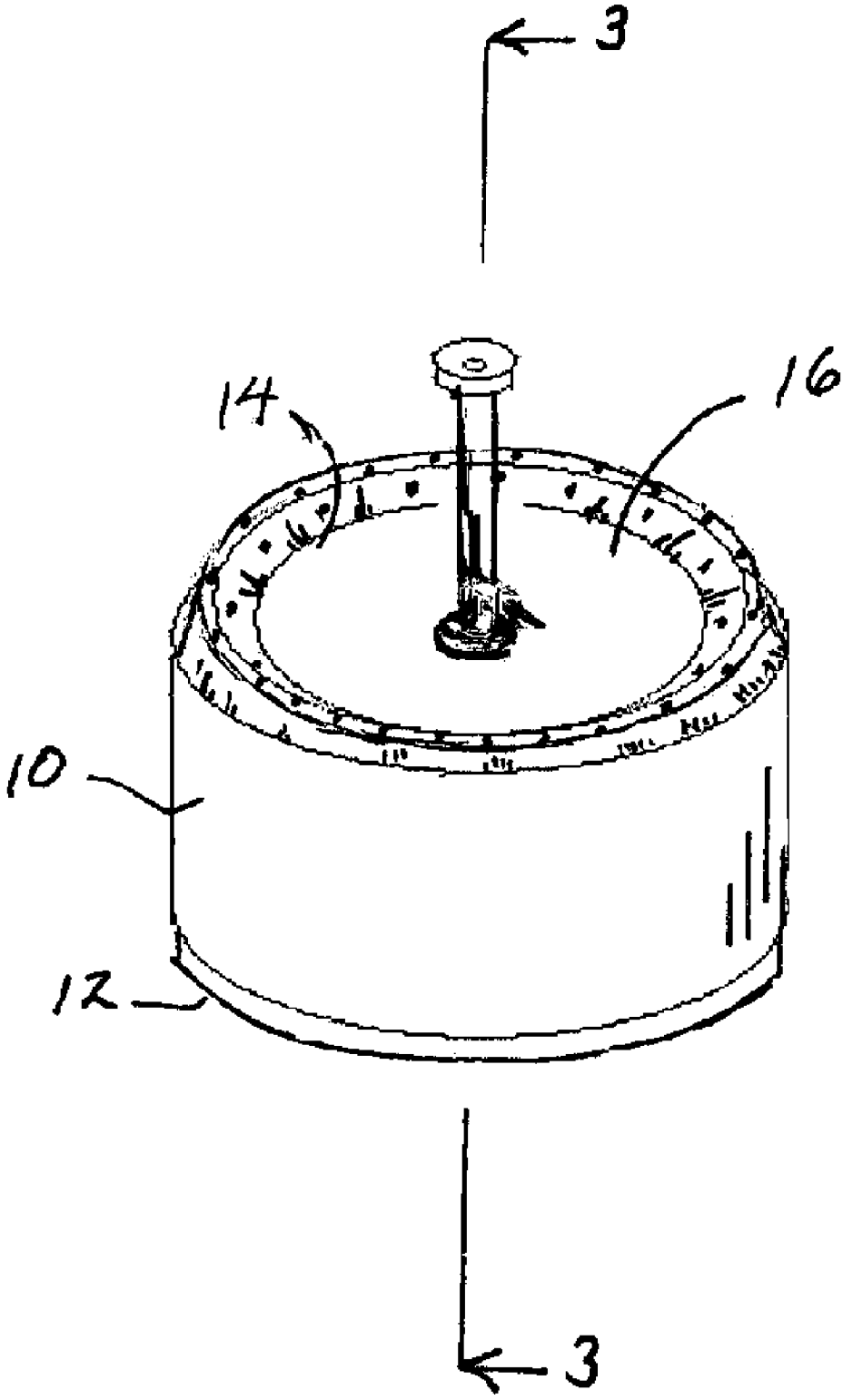
FIG. 2 is a perspective view of the assembled ultralight stove of FIG. 1.
Figure 3:
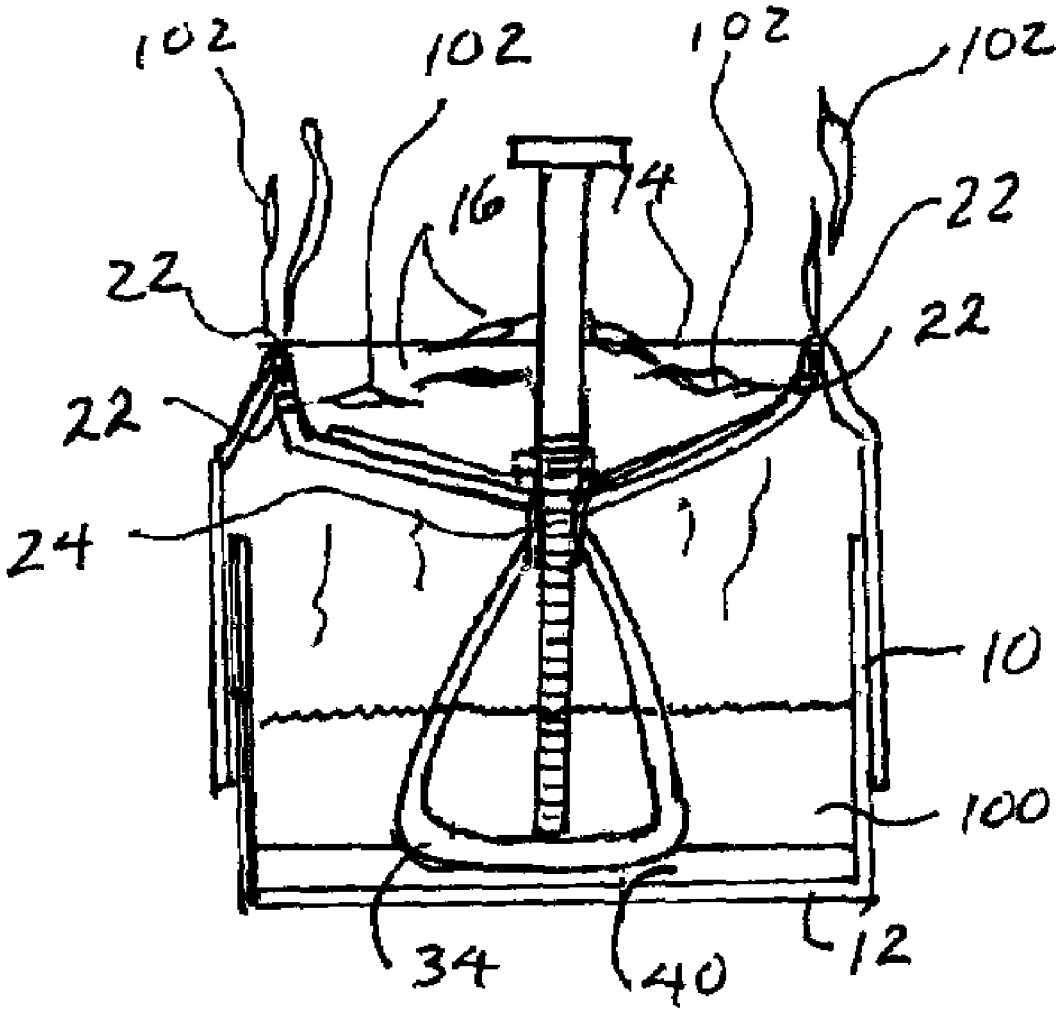
FIG. 3 is a view of the assembled stove along the view line 3-3 of FIG. 2

The ultralight stove of the present invention comprises a fuel reservoir 10 with a bottom 12 and a concave top 14 opening upward forming a recess 16 with a filler hole 18 at its center 20 such that fuel 100 poured into the recess 16 is funneled into the filler hole 18 through which fuel 100 may be loaded into the reservoir 10. A plurality of jet holes 22 in the reservoir top 14 opening into the reservoir 10 allows vaporized fuel to escape. Thus, the reservoir 10 remains unpressurized when the reservoir is unheated.

A rivet nut 24 with a threaded central hole 26 therethrough comprises the filler hole 18. A heat conducting heat transfer plug 28 that includes an externally threaded shaft 30 matches the threaded central hole 26 into which it is removably threaded, thus plugging the threaded central hole 26 during stove operation such that fuel escapes from the reservoir only through the jet holes 22. A heat transfer plug upward portion 32 extends upward from the stove top 14 with at least a portion of the jet holes 14' directed toward the heat transfer plug upward portion 32 such that fuel escaping from said portion of the jet holes 14' when ignited produces flames 102 that intersect and heat the heat transfer plug upward portion 32. The heat is then conducted through the heat transfer plug 28 to the reservoir 10 where it heats fuel 100 in the reservoir 10 causing increased fuel vaporization. The increased fuel vaporization pressurizes the reservoir 10 causing pressurized fuel to escape through the jet holes 22 resulting in increased heat to the heat transfer plug upward portion 32 which further heats the fuel in the reservoir. The cycle of further heating and increased pressure of vaporization continues until a fuel consumption and temperature equilibrium is obtained where the heat transfer plug 28 and reservoir 10 reach maximum operating temperatures.

A heat transfer conduit 34 internal the reservoir 10 extends centrally in the reservoir generally from the heat transfer plug 28 when the heat transfer plug 28 is threaded into the rivet hole 26. Typically the heat transfer conduit 34 and heat transfer plug 28 extend to the reservoir bottom 12 or near the reservoir bottom 12. The heat transfer conduit 34 connected to the heat transfer plug 28 conducts heat from the heat transfer plug 28 to fuel 100 in the reservoir 10. To assure that all fuel is heated until it is fully consumed, an internal fuel absorber 40 internal the reservoir 10 adapted to absorb fuel 100 is on the reservoir bottom 12 and in contact with the internal fuel absorber 40. Any fuel in the reservoir 10 is absorbed into the internal fuel absorber 40 until it is saturated and heated by the heat transfer conduit 34 to assure even the last fuel in the reservoir is heated and consumed.

An external fuel absorber 42 on the reservoir top 14 is provided for stove initiation. The external fuel absorber 42 is typically secured to the reservoir top 14 by a fine mesh screen 44. Stove operation is initiated by adding fuel to the external fuel absorber 42 which is then ignited. Heat generated from fuel burning from the external fuel absorber 42 heats the heat transfer plug 28. Heat is conducted to fuel 100 in the reservoir 10 which is then heated to increase fuel vaporization and escape through the jet holes. The burning fuel from the external fuel absorber 42 ignites vaporized fuel escaping from the jet holes 22 before the fuel in the external fuel absorber 42 is spent and the stove becomes self-sustaining.

What is claimed is:

1. An ultralight stove for producing heat and flames from burning fuel, comprising a fuel reservoir with a bottom and a top, a heat conducting heat transfer plug that extends upward from the stove top and is heated by flames of burning fuel from the stove that are directed toward the heat transfer plug during operation for heating the heat transfer plug, which heat transfer plug also extends downward from the top into the reservoir and into fuel that may be loaded therein as a heat conduit that heats the fuel.

2. The ultralight stove of claim 1 further comprising a heat transfer conduit internal the reservoir that extends centrally in the reservoir generally from the heat transfer plug to or to near the reservoir bottom therein conducting heat from the heat transfer plug to fuel that may be loaded in the reservoir.

3. An ultralight stove for producing heat and flames from burning fuel, comprising a fuel reservoir with a bottom and a top with a filler hole therein through which fuel may be loaded into the reservoir and having a plurality of jet holes in the top through which vaporized fuel escapes, maintaining the reservoir unpressurized when the reservoir is unheated, a heat conducting heat transfer plug removably received into the filler hole and plugging the filler hole when received therein and remaining as a heat transfer plug in the filler hole during stove operation such that fuel escapes from the reservoir only through the jet holes, a heat transfer plug upward portion extending upward from the stove top, at least a portion of the jet holes directed toward the heat transfer plug upward portion such that fuel escaping from said portion of the jet holes when ignited produces flames that intersect and heat the heat transfer plug upward portion, said heat being conducted through the heat transfer plug to the reservoir where it heats said fuel in the reservoir causing increased fuel vaporization that pressurizes the reservoir causing pressurized fuel to escape through the jet holes resulting in increased heat to the heat transfer plug upward portion which further heats said fuel in the reservoir, the cycle continuing until a fuel consumption and temperature equilibrium is obtained where the heat transfer plug and reservoir reach maximum operating temperatures.

4. The ultralight stove of claim 3 further comprising an external fuel absorber on the reservoir top to which fuel may be added which when ignited heats the heat transfer plug to initiate stove operation such that before fuel in the external fuel absorber is spent, fuel in the reservoir is sufficiently heated to cause vaporized fuel to jet from said portion of the jet holes and be ignited.

5. The ultralight stove of claim 3 further comprising a heat transfer conduit internal the reservoir.

6. The ultralight stove of claim 5 wherein said heat transfer conduit extends between the reservoir top and the reservoir bottom or near the reservoir bottom.

7. The ultralight stove of claim 6 wherein the heat transfer conduit extends centrally in the reservoir generally.

8. The ultralight stove of claim 6 wherein said heat transfer conduit extends from the heat transfer plug when inserted to heat transfer plug the filler hole such that heat in the heat transfer plug is conducted to the heat transfer conduit.

9. The ultralight stove of claim 6 wherein the heat transfer conduit comprises multiple components.

10. The ultralight stove of claim 7 wherein each of said multiple components extends between the reservoir top and the reservoir bottom or near the reservoir bottom.

11. The ultralight stove of claim 3 further comprising an internal fuel absorber internal the reservoir on the reservoir bottom.

12. The ultralight stove of claim 6 further comprising an internal fuel absorber internal the reservoir on the reservoir bottom.

13. The ultralight stove of claim 12 wherein the heat transfer conduit is in contact with the internal fuel absorber such that heat is transferred to the internal fuel absorber and any fuel in the internal fuel absorber.

14. The ultralight stove of claim 3 further comprising a rivet nut with a threaded central hole therethrough secured in the filler hole wherein fuel may be loaded into the reservoir through the threaded central hole, and wherein the heat transfer plug includes an externally threaded shaft matching the threaded central hole into which it is removably threaded.

15. The ultralight stove of claim 3 wherein the reservoir top is concave opening upward forming a recess with the filler hole at its center such that fuel poured into the recess is funneled into the filler hole.

16. The ultralight stove of claim 15 further comprising an external fuel absorber within the recess to which fuel may be added which when ignited heats the heat transfer plug to initiate stove operation such that before fuel in the external fuel absorber is spent, fuel in the reservoir is sufficiently heated to cause vaporized fuel to jet from said portion of the jet holes and be ignited.

17. The ultralight stove of claim 3 wherein the heat transfer plug extends into the reservoir to near the reservoir bottom as a heat conduit operationally heating and vaporizing said fuel.

18. An ultralight stove for producing heat and flames from burning fuel, comprising a fuel reservoir with a bottom and a concave top opening upward forming a recess with a filler hole at its center such that fuel poured into the recess is funneled into the filler hole through which fuel may be loaded into the reservoir and further having a plurality of jet holes in the top through which vaporized fuel escapes, maintaining the reservoir unpressurized when the reservoir is unheated, a rivet nut with a threaded central hole therethrough comprising said filler hole, a heat conducting heat transfer plug including an externally threaded shaft matching the threaded central hole into which it is removably threaded plugging the threaded central hole during stove operation such that fuel escapes from the reservoir only through the jet holes, a heat transfer plug upward portion extending upward from the stove top, at least a portion of the jet holes directed toward the heat transfer plug upward portion such that fuel escaping from said portion of the jet holes when ignited produces flames that intersect and heat the heat transfer plug upward portion, said heat being conducted through the heat transfer plug to the reservoir where it heats said fuel in the reservoir causing increased fuel vaporization that pressurizes the reservoir causing pressurized fuel to escape through the jet holes resulting in increased heat to the heat transfer plug upward portion which further heats said fuel in the reservoir, the cycle continuing until a fuel consumption and temperature equilibrium is obtained where the heat transfer plug and reservoir reach maximum operating temperatures, a heat transfer conduit internal the reservoir that extends centrally in the reservoir generally from the heat transfer plug when inserted to heat transfer plug the filler hole to or to near the reservoir bottom therein conducting heat from the heat transfer plug to fuel that may be loaded in the reservoir, an external fuel absorber within the recess on the reservoir top to which fuel may be added which when ignited heats the heat transfer plug to initiate stove operation such that before fuel in the external fuel absorber is spent, fuel in the reservoir is sufficiently heated to cause vaporized fuel to jet from said portion of the jet holes and be ignited, an internal fuel absorber internal the reservoir on the reservoir bottom in contact with the heat transfer conduit such that heat is transferred to the internal fuel absorber and fuel in the internal fuel absorber.

* * * * *